US009528480B2

(12) United States Patent
Omeri

(10) Patent No.: US 9,528,480 B2
(45) Date of Patent: Dec. 27, 2016

(54) VALVE ASSEMBLY FOR AN INJECTION VALVE AND INJECTION VALVE

(75) Inventor: Marco Omeri, Viareggio (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 728 days.

(21) Appl. No.: 13/876,850

(22) PCT Filed: Aug. 17, 2011

(86) PCT No.: PCT/EP2011/064189

§ 371 (c)(1),
(2), (4) Date: Jul. 10, 2013

(87) PCT Pub. No.: WO2012/041597

PCT Pub. Date: Apr. 5, 2012

(65) Prior Publication Data

US 2013/0277460 A1 Oct. 24, 2013

(30) Foreign Application Priority Data

Oct. 1, 2010 (EP) ..... 10186239

(51) Int. Cl.
*F02M 51/06* (2006.01)
*F02M 61/16* (2006.01)

(52) U.S. Cl.
CPC ..... *F02M 51/06* (2013.01); *F02M 51/0685* (2013.01); *F02M 61/161* (2013.01); *F02M 2200/304* (2013.01); *F02M 2200/306* (2013.01)

(58) Field of Classification Search
CPC ..... F02M 51/0635; F02M 61/205; F02M 63/0075; F02M 2200/306; F02M 2200/304; F02M 51/06; F02M 51/0685; F02M 61/161

(Continued)

(56) References Cited

U.S. PATENT DOCUMENTS 4,984,549 A * 1/1991 Mesenich ..... F02M 51/0625 123/472
6,279,873 B1 * 8/2001 Eichendorf ..... F02M 51/0685 251/129.19

(Continued)

FOREIGN PATENT DOCUMENTS

CN 101298856 A 11/2008 ..... F02M 51/06
DE 10256661 A1 6/2004 ..... F02M 51/06

(Continued)

OTHER PUBLICATIONS

Chinese Office Action, Application No. 201180047480, 9 pages, Jul. 31, 2014.

(Continued)

*Primary Examiner* — Arthur O Hall
*Assistant Examiner* — Juan C Barrera
(74) *Attorney, Agent, or Firm* — Slayden Grubert Beard PLLC

(57) ABSTRACT

A valve assembly includes a valve body having a cavity with a fluid inlet portion and a fluid outlet portion, a valve needle axially movable in the cavity to control a fluid flow through the fluid outlet portion, a guide coupled to the valve needle, an electro-magnetic actuator unit configured to actuate the valve needle and comprising an armature axially moveable in the cavity relative to the valve needle, the armature configured to be coupled to the guide when the valve needle leaves the closing position and configured to mechanically decouple from the guide due to its inertia when the valve needle reaches the closing position, and an armature spring coupled to the armature to provide a force to the armature contributing coupling the armature with the valve needle. A block-shaped stop element axially adjacent the armature and coupled to the valve body limits the axial movement of the armature.

11 Claims, 2 Drawing Sheets

(58) Field of Classification Search
USPC ..... 239/585.5
See application file for complete search history.

(56) References Cited

U.S. PATENT DOCUMENTS

| | | | | |
|---|---|---|---|---|
| 6,510,841 | B1 | 1/2003 | Stier | 123/472 |
| 6,808,133 | B1 * | 10/2004 | Stier | F02M 51/0614 239/585.1 |
| 8,496,192 | B2 | 7/2013 | Mancini et al. | 239/533.7 |
| 2003/0189112 | A1 * | 10/2003 | Fukutomi | F02M 51/0671 239/585.1 |
| 2006/0163390 | A1 | 7/2006 | Ruehle et al. | 239/585.1 |
| 2010/0012754 | A1 * | 1/2010 | Hayatani | F02M 51/0671 239/585.5 |

FOREIGN PATENT DOCUMENTS

| | | | | |
|---|---|---|---|---|
| DE | 10257896 | A1 | 7/2004 | F02M 51/06 |
| WO | 2012/041597 | A1 | 4/2012 | F02M 51/06 |

OTHER PUBLICATIONS

International Search Report and Written Opinion, Application No. PCT/EP2011/064189, 9 pages, Sep. 23, 2011.

* cited by examiner

VALVE ASSEMBLY FOR AN INJECTION VALVE AND INJECTION VALVE

CROSS-REFERENCE TO RELATED APPLICATIONS

This application is a U.S. National Stage Application of International Application No. PCT/EP2011/064189 filed Aug. 17, 2011, which designates the United States of America, and claims priority to EP Application No. 10186239.9 filed Oct. 1, 2010, the contents of which are hereby incorporated by reference in their entirety.

TECHNICAL FIELD

The disclosure relates to a valve assembly for an injection valve and an injection valve.

BACKGROUND

Injection valves are in wide spread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or piezo electric actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of up to 2000 bar.

SUMMARY

One embodiment provides a valve assembly for an injection valve, with a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, a guide being arranged in the cavity and being fixedly coupled to the valve needle, an electro-magnetic actuator unit being designed to actuate the valve needle, the actuator unit comprising an armature which is arranged in the cavity and is axially moveable relative to the valve needle, the armature being designed to be coupled to the guide when the valve needle is actuated to leave the closing position, and the armature being designed and arranged to mechanically decouple from the guide due to its inertia when the valve needle reaches the closing position, and an armature spring being arranged in the cavity and being coupled to the armature axially adjacent to the armature, the armature spring being arranged to provide a force to the armature contributing coupling the armature with the valve needle, wherein a block-shaped stop element is arranged in the cavity axially adjacent to the armature and is fixedly coupled to the valve body, the stop element being designed directly to limit the axial movement of the armature, and wherein the armature has a plane surface facing the fluid outlet portion, and the block-shaped stop element has a plane surface facing the plane surface of the armature, and the plane surface of the armature is coupleable to the plane surface of the stop element by adhesion caused by a sticking effect due to a thin layer of fluid which is located in a gap between the plane surface of the armature and the plane surface of the stop element.

In a further embodiment, the block-shaped stop element comprises a through-hole hydraulically coupling the fluid inlet portion with the fluid outlet portion.

In a further embodiment, the stop element is press-fitted to the valve body.

In a further embodiment, the stop element is welded to the valve body.

In a further embodiment, the stop element comprises a protrusion extending in radial direction, and the armature spring is arranged axially between the protrusion of the stop element and the armature, the armature spring being designed to fixedly couple the stop element to the valve body.

In a further embodiment, the stop element is of a non-magnetic material or of a plurality of non-magnetic materials.

Another embodiment provides an injection valve with a valve assembly as disclosed above.

Another embodiment provides a valve assembly for an injection valve, comprising a valve body including a central longitudinal axis, the valve body comprising a cavity with a fluid inlet portion and a fluid outlet portion, a valve needle, a guide being arranged in the cavity and being fixedly coupled to the valve needle, an electro-magnetic actuator unit being designed to actuate the valve needle, the actuator unit comprising an armature, and an armature spring being arranged in the cavity and being coupled to the armature axially adjacent to the armature, a block-shaped stop element being arranged in the cavity axially adjacent to the armature and being fixedly coupled to the valve body, wherein the valve needle is axially movable in the cavity, the valve needle preventing a fluid flow through the fluid outlet portion in a closing position and releasing the fluid flow through the fluid outlet portion in further positions, wherein the armature is arranged in the cavity and is axially moveable relative to the valve needle, wherein the armature is operable to mechanically couple to the guide for moving the valve needle out of the closing position, wherein the armature is operable, by means of its inertia, to mechanically decouple from the guide when the valve needle reaches the closing position and to move in the direction towards the stop element, wherein the stop element is designed to limit the axial movement of the armature, wherein the armature spring is operable to provide a force to the armature, the force being directed towards the guide and away from the stop element, and wherein the armature has a plane surface facing the fluid outlet portion, and the block-shaped stop element has a plane surface facing the plane surface of the armature, and the plane surface of the armature is coupleable to the plane surface of the stop element by adhesion caused by a sticking effect due to a thin layer of fluid which is located in a gap between the plane surface of the armature and the plane surface of the stop element, so that the thin layer of fluid is operable to dampen a movement of the armature towards the fluid inlet portion.

BRIEF DESCRIPTION OF THE DRAWINGS

Exemplary embodiments will be explained in more detail below based on the schematic drawings, wherein.

DETAILED DESCRIPTION

Figure 1:
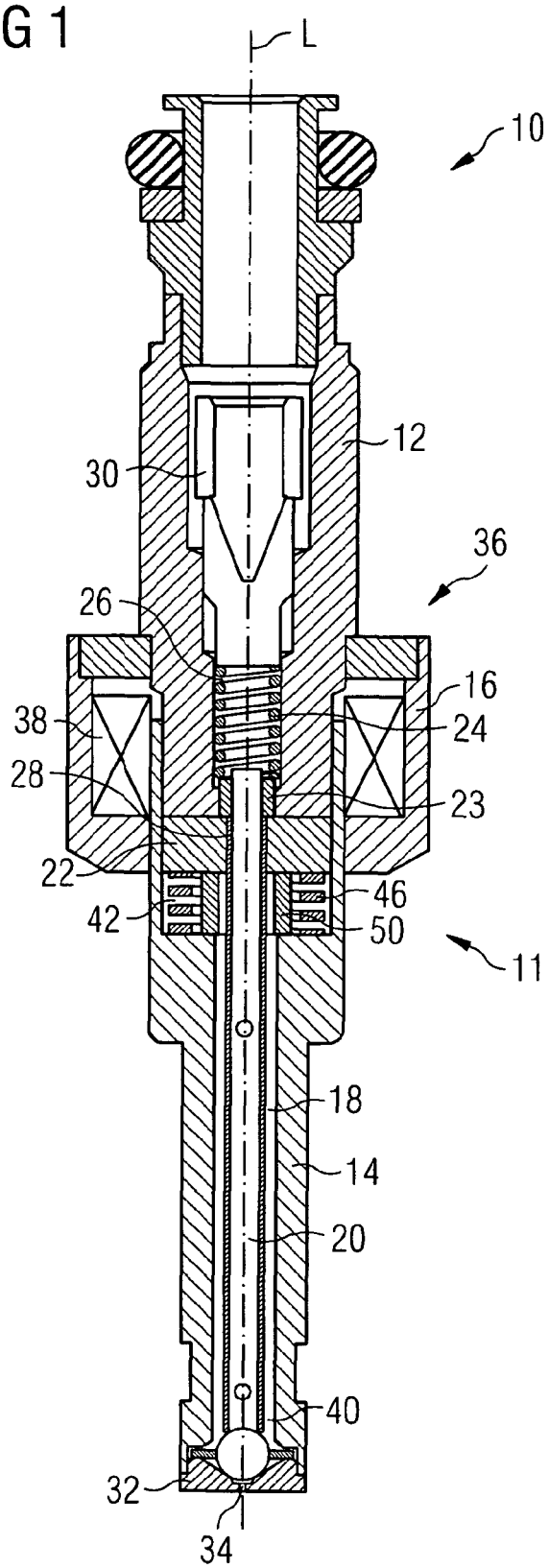
FIG. 1, an injection valve in a longitudinal section view.

Embodiments of the present disclosure provide a valve assembly and an injection valve which facilitate a reliable and precise function of the injection valve.

Some embodiments provide a valve assembly for an injection valve, with a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, a guide being arranged in the cavity and being fixedly coupled to the valve needle, an electro-magnetic actuator unit being designed to actuate the valve needle, the actuator unit comprising an armature which is arranged in the cavity and is axially moveable relative to the valve needle, the armature being designed to be coupled to the guide when the valve needle leaves the closing position, and the armature being designed and arranged to mechanically decouple from the guide due to its inertia when the valve needle reaches the closing position, and an armature spring being arranged in the cavity and being coupled to the armature axially adjacent to the armature. The armature spring is arranged to provide a force to the armature contributing coupling the armature with the valve needle. A block-shaped stop element is arranged in the cavity axially adjacent to the armature and is fixedly coupled to the valve body, the stop element being designed directly to limit the axial movement of the armature.

The limitation of the axial movement of the armature directly by the stop element is obtained by a direct contact of the armature with the stop element. The stop element is designed and arranged to limit the axial movement of the armature inside a range of elastic deformation of the armature spring.

This has the advantage that during the valve needle moves into its closing position the maximum axial displacement of the armature may be limited by the block-shaped stop element. Therefore, the dynamic of the armature can be damped. Consequently, when the valve needle is moving in its closing position a bouncing of the armature and a bouncing of the valve needle can be avoided. Consequently, an unwanted fluid flow through the fluid outlet portion may be prevented.

In one embodiment the armature has a plane surface facing the fluid outlet portion, and the block-shaped stop element has a plane surface facing the surface of the armature. The plane surface of the armature is coupable to the plane surface of the stop element by adhesion. The adhesion is caused by a sticking effect due to a thin layer of fluid which is located in a gap between the plane surface of the armature and the plane surface of the stop element. This has the advantage that the dynamic of the armature can be limited or damped by a sticking effect caused by the adhesion between the plane surface of the armature and the plane surface of the stop element. Therefore, the bouncing of the armature and the bouncing of the valve needle can be avoided.

In a further embodiment the block-shaped stop element comprises a through-hole hydraulically coupling the fluid inlet portion with the fluid outlet portion. By this a good fluid flow management inside the valve body may be obtained. Furthermore, the kinetic energy of the armature may be absorbed and dissipated by the block-shaped stop element in a very good manner.

In a further embodiment the stop element is press-fitted to the valve body. By this a secure coupling between the stop element and the valve body is possible and the position of the stop element may be defined very exactly.

In a further embodiment the stop element is welded to the valve body. By this a secure coupling between the stop element and the valve body is possible and the position of the stop element may be defined very exactly.

In a further embodiment the stop element comprises a protrusion extending in radial direction. The armature spring is arranged axially between the protrusion of the stop element and the armature. The armature spring is designed to fixedly couple the stop element to the valve body. This has the advantage that a secure coupling between the stop element and the valve body is possible. Consequently, the position of the stop element may be defined very exactly.

In a further embodiment the stop element is of a non-magnetic material or of a plurality of non-magnetic materials. This has the advantage that the stop element does not influence the electromagnetic properties of the electro-magnetic actuator unit.

Other embodiments provide an injection valve with a valve assembly as disclosed above.

FIG. 1 shows an injection valve 10 that is suitable for dosing fluids and which comprises a valve assembly 11 and an inlet tube 12. The injection valve 10 may be in particular suitable for dosing fuel to an internal combustion engine.

The valve assembly 11 comprises a valve body 14 with a central longitudinal axis L and a housing 16. The housing 16 is partially arranged around the valve body 14. A cavity 18 is arranged in the valve body 14.

The cavity 18 takes in a valve needle 20 and an armature 22. A guide 23 is arranged axially adjacent to the armature 22. The guide 23 is fixedly coupled to the valve needle 14. The guide 23 is formed as a collar around the valve needle 14. A main spring 24 is arranged in a recess 26 provided in the inlet tube 12. The recess 26 is part of the cavity 18. The main spring 24 is mechanically coupled to the guide 23. The guide 23 is in contact with an inner side of the inlet tube 12 and can guide the valve needle 14 in axial direction inside the inlet tube 12. The main spring 24 is arranged and designed to act on the valve needle 20 to move the valve needle 20 in axial direction in its closing position. A filter element 30 is arranged in the inlet tube 12 and forms a further seat for the main spring 24.

In a closing position of the valve needle 20 it sealingly rests on a seat plate 32 by this preventing a fluid flow through an injection nozzle 34. The injection nozzle 34 may be, for example, an injection hole. However, it may also be of some other type suitable for dosing fluid.

The valve assembly 11 is provided with an actuator unit 36, e.g., an electro-magnetic actuator. The electro-magnetic actuator unit 36 comprises a coil 38, which may be arranged inside the housing 16. Furthermore, the electro-magnetic actuator unit 36 comprises the armature 22. The armature 22 is arranged in the cavity 18 and axially movable relative to the valve needle 20. The housing 16, the valve body 14, the inlet tube 12 and the armature 22 are forming an electro-magnetic circuit.

A fluid outlet portion 40 is a part of the cavity 18 near the seat plate 32. The fluid outlet portion 40 communicates with a fluid inlet portion 42 being provided in the valve body 14.

An armature spring 46, e.g., a coil spring, is arranged in the cavity 18 and is fixedly coupled to the valve body 14. The armature spring 46 is arranged axially adjacent to the armature 22. The armature spring 46 is coupled to the armature 22.

Figure 2:
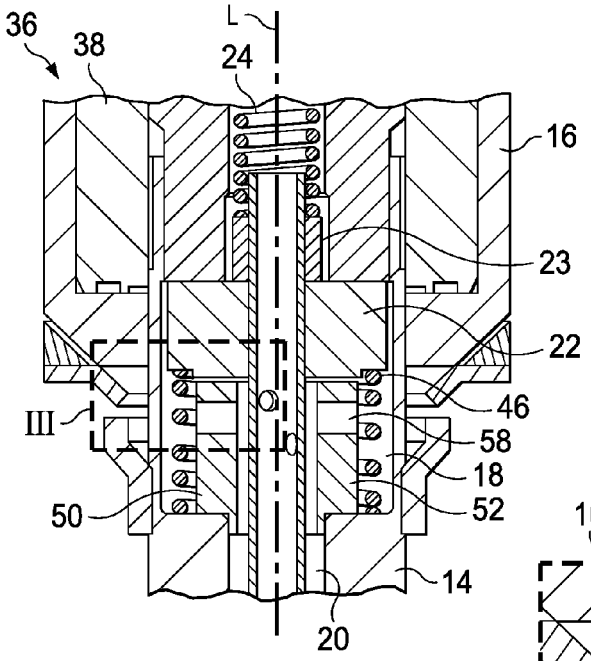
FIG. 2, a first embodiment of a valve assembly in a longitudinal section view, FIG. 3, an enlarged view of a detail III of FIG. 2, and FIG. 4, a second embodiment of the valve assembly in a longitudinal section view.

A block-shaped stop element 50 is arranged in the cavity 18 axially adjacent to the armature 22. The stop element 50 is fixedly coupled to the valve body 14. The stop element 50 may be of a non-magnetic material. Therefore, the stop element 50 does not influence the electromagnetic properties of the actuator unit 36. In the embodiment of FIG. 2, the stop element 50 is internally press-fitted to the valve body 14.

Figure 4:
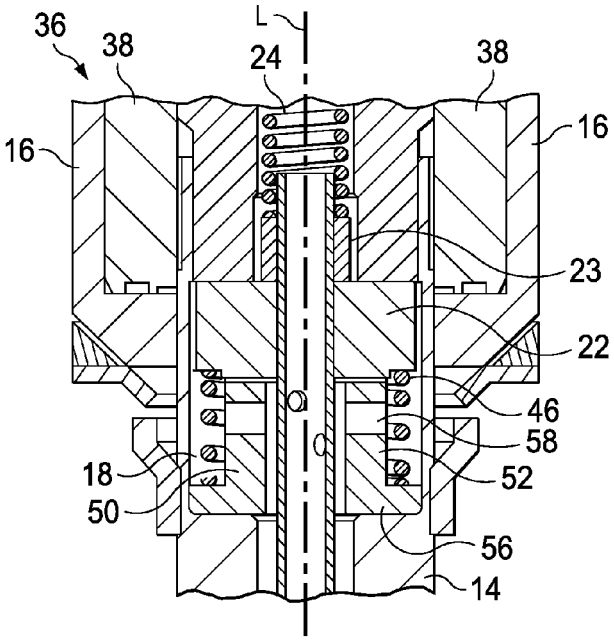

The block-shaped stop element 50 has a main body 52 with a plane surface 54 which faces a plane surface 44 of the armature 22. The plane surface 44 of the armature 22 faces the fluid outlet portion 40. The block-shaped stop element 50 has a through-hole 58. The through-hole 58 hydraulically couples the fluid inlet portion 42 with the fluid outlet portion 40. In the embodiment of FIG. 4, the stop element 50 has a protrusion 56. The protrusion 56 extends in radial direction from the main body 52. The armature spring 46 is arranged axially between the protrusion 56 and the armature 22. Due to its elastic force the armature spring 46 may fixedly couple the stop element 50 to the valve body 14. The stop element 50 may be externally press-fitted to the valve body 14. In further embodiments, the stop element 50 may be coupled to the valve body 14 by welding.

In the following, the function of the injection valve 10 is described in detail:

The fluid is led through the inlet tube 12 to the fluid inlet portion 42 of the valve assembly 11 and further towards the fluid outlet portion 40.

The valve needle 20 prevents a fluid flow through the fluid outlet portion 40 in the valve body 14 in a closing position of the valve needle 20. Outside of the closing position of the valve needle 20, the valve needle 20 enables the fluid flow through the fluid outlet portion 40.

If the electro-magnetic actuator unit 36 with the coil 38 gets energized the actuator unit 36 may effect an electro-magnetic force on the armature 22. The armature 22 is attracted by the electro-magnetic actuator unit 36 with the coil 38 and may move in axial direction away from the fluid outlet portion 40. The armature 22 takes the guide 23 and the valve needle 20 with it so that the valve needle 20 moves in axial direction out of the closing position. Outside of the closing position of the valve needle 20 a fluid path is formed between the seat plate 32 and the valve needle 20 and fluid can pass through the injection nozzle 34.

In the case that the actuator unit 36 is de-energized the main spring 24 can force the valve needle 20 to move in axial direction in its closing position. It is depending on the force balance between the force on the valve needle 20 caused by the actuator unit 36 and the force on the valve needle 20 caused by the main spring 24 whether the valve needle 20 moves in its closing position or not.

In the case that the valve needle 20 moves in its closing position the armature 22 may decouple from the guide 23 due to its inertia and may move in direction to the block-shaped stop element 50. When the armature 22 comes into contact with the stop element 50 the axial movement of the armature 22 is limited in direction to the fluid outlet portion 40 at an axial position P which is equal to the position of the plane surface 54 of the stop element 50. The stop element 50 is arranged and designed in a manner that the position P is inside a range of displacement of the armature 22 due to a range of elastic deformation of the armature spring 46.

The kinetic energy of the armature 22 may be at least absorbed and dissipated by the block-shaped stop element 50. Consequently, the movement of the armature 22 may be damped. In particular, the through-hole 58 enables a good absorption of the kinetic energy of the armature 22 by the stop element 50.

Figure 3:
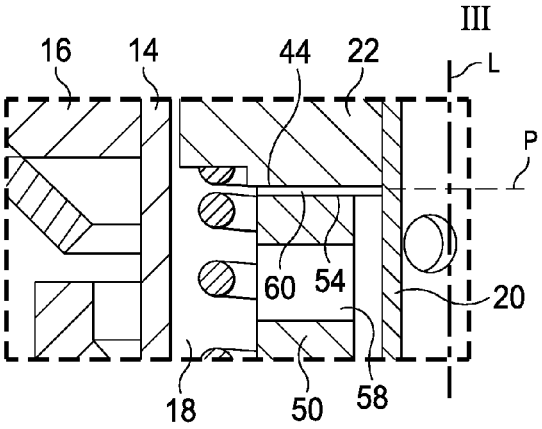

A gap 60 which may be very small can occur between the armature 22 and the block-shaped stop element 50 (FIG. 3). The plane surface 44 of the armature 22 may be coupled to the plane surface 54 of the stop element 50 by adhesion caused by a layer of fluid which is located in the gap 60. Due to the adhesion forces between the plane surface 44 of the armature 22 and the plane surface 54 of the stop element 50 a movement of the armature 22 back into the direction to the inlet tube 12 may be damped also in the case that the armature 22 does not come into contact with the stop element 50. Consequently, a bouncing of the armature 22 and the valve needle 20 may be avoided, and unwanted injections may be prevented only by the sticking effect between the plane surface 44 of the armature 22 and the plane surface 54 of the stop element 50 without a contact between the plane surfaces 44,54. The dimension and the shape of the plane surfaces 44, 54 may influence the size of the dampening effect. In the end of the movement of the armature 22 during the closing of the valve needle 20 the armature spring 46 forces the armature 22 to come again into contact with the guide 23.

What is claimed is:

1. Valve assembly for an injection valve, comprising:

a valve body having a central longitudinal axis and comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, a guide arranged in the cavity and fixedly coupled to the valve needle, an electro-magnetic actuator unit configured to actuate the valve needle, the actuator unit comprising an armature arranged in the cavity and axially moveable relative to the valve needle, the armature configured to be coupled to the guide when the valve needle is actuated to leave the closing position, and the armature configured to mechanically decouple from the guide due to inertia of the armature when the valve needle reaches the closing position, and an armature spring arranged in the cavity and coupled to the armature axially adjacent to the armature, the armature spring configured to provide a force to the armature contributing coupling the armature with the valve needle, wherein a block-shaped stop element is arranged in the cavity axially adjacent to the armature and is fixedly coupled to the valve body, the stop element configured to limit the axial movement of the armature, wherein the block-shaped stop element includes a protrusion extending radially outward from the stop element and the armature spring is compressed between the armature and the protrusion of the stop element thereby exerting a force tending to physically separate the armature and the stop element, and wherein the armature has a plane surface facing the fluid outlet portion, and the block-shaped stop element has a plane surface facing the plane surface of the armature, and the plane surface of the armature is coupleable to the plane surface of the stop element by adhesion caused by a sticking effect due to a thin layer of fluid which is located in a gap between the plane surface of the armature and the plane surface of the stop element.

2. Valve assembly of claim 1, wherein the block-shaped stop element comprises a through-hole hydraulically coupling the fluid inlet portion with the fluid outlet portion.

3. Valve assembly of claim 1, wherein the stop element is press-fitted to the valve body.

4. Valve assembly of claim 1, wherein the stop element is welded to the valve body.

5. Valve assembly of claim 1, wherein the stop element is of a non-magnetic material or of a plurality of non-magnetic materials.

6. Injection valve comprising:

a valve assembly including:

a valve body having a central longitudinal axis and comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, a guide arranged in the cavity and fixedly coupled to the valve needle, an electro-magnetic actuator unit configured to actuate the valve needle, the actuator unit comprising an armature arranged in the cavity and axially moveable relative to the valve needle, the armature configured to be coupled to the guide when the valve needle is actuated to leave the closing position, and the armature configured to mechanically decouple from the guide due to inertia of the armature when the valve needle reaches the closing position, and an armature spring arranged in the cavity and coupled to the armature axially adjacent to the armature, the armature spring configured to provide a force to the armature contributing coupling the armature with the valve needle, wherein a block-shaped stop element is arranged in the cavity axially adjacent to the armature and is fixedly coupled to the valve body, the stop element configured to limit the axial movement of the armature, wherein the block-shaped stop element includes a protrusion extending radially outward from the stop element and the armature spring is compressed between the armature and the protrusion of the stop element thereby exerting a force tending to physically separate the armature and the stop element, and wherein the armature has a plane surface facing the fluid outlet portion, and the block-shaped stop element has a plane surface facing the plane surface of the armature, and the plane surface of the armature is coupleable to the plane surface of the stop element by adhesion caused by a sticking effect due to a thin layer of fluid which is located in a gap between the plane surface of the armature and the plane surface of the stop element.

7. Valve assembly for an injection valve, comprising:

a valve body having a central longitudinal axis and comprising a cavity with a fluid inlet portion and a fluid outlet portion, a valve needle, a guide being arranged in the cavity and fixedly coupled to the valve needle, an electro-magnetic actuator unit configured to actuate the valve needle, the actuator unit comprising an armature, and an armature spring arranged in the cavity and coupled to the armature axially adjacent to the armature, a block-shaped stop element arranged in the cavity axially adjacent to the armature and fixedly coupled to the valve body, wherein the valve needle is axially movable in the cavity, the valve needle preventing a fluid flow through the fluid outlet portion in a closing position and releasing the fluid flow through the fluid outlet portion in further positions, wherein the armature is arranged in the cavity and axially moveable relative to the valve needle, wherein the armature is operable to mechanically couple to the guide for moving the valve needle out of the closing position, wherein the armature is operable, due to its inertia, to mechanically decouple from the guide when the valve needle reaches the closing position and to move in the direction towards the stop element, wherein the stop element is configured to limit the axial movement of the armature and wherein the armature spring is operable to provide a force to the armature, the force being directed towards the guide and away from the stop element, wherein the block-shaped stop element includes a protrusion extending radially outward from the stop element and the armature spring is compressed between the armature and the protrusion of the stop element thereby exerting a force tending to physically separate the armature and the stop element, and wherein the armature has a plane surface facing the fluid outlet portion, and the block-shaped stop element has a plane surface facing the plane surface of the armature, and the plane surface of the armature is coupleable to the plane surface of the stop element by adhesion caused by a sticking effect due to a thin layer of fluid which is located in a gap between the plane surface of the armature and the plane surface of the stop element, so that the thin layer of fluid is operable to dampen a movement of the armature towards the fluid inlet portion.

8. Valve assembly of claim 7, wherein the block-shaped stop element comprises a through-hole hydraulically coupling the fluid inlet portion with the fluid outlet portion.

9. Valve assembly of claim 7, wherein the stop element is press-fitted to the valve body.

10. Valve assembly of claim 7, wherein the stop element is welded to the valve body.

11. Valve assembly of claim 7, wherein the stop element is of a non-magnetic material or of a plurality of non-magnetic materials.

* * * * *